United States Patent [19]

Crystal et al.

[11] Patent Number: 5,072,234

[45] Date of Patent: Dec. 10, 1991

[54] THERMAL TRANSFER PRINTING ELEMENTS WITH MESOMORPHIC INKS

[75] Inventors: Richard G. Crystal, Los Altos, Calif.; Hardy Sonnenberg, Puslinch, Canada

[73] Assignee: Xerox Corporation, Stamford, Conn.

[21] Appl. No.: 454,817

[22] Filed: Dec. 21, 1989

[51] Int. Cl.[5] ..... B41M 5/035

[52] U.S. Cl. ..... 346/1.1; 428/1; 428/195; 428/210; 428/211; 428/321.3; 428/336; 428/419; 428/447; 428/412; 428/458; 428/474.4; 428/484; 428/488.1; 428/500; 428/522; 428/694; 428/900; 428/914

[58] Field of Search ..... 428/1, 195, 321.3, 336, 428/900, 913, 914, 210, 211, 419, 447, 412, 458, 474.4, 484, 488.1, 500, 522, 694; 156/234, 277; 427/256; 346/1.1

[56] References Cited

U.S. PATENT DOCUMENTS

| | | | |
|---|---|---|---|
| 3,287,153 | 11/1966 | Schwarz | 117/36.1 |
| 3,348,651 | 10/1967 | Mater et al. | 197/172 |
| 3,392,042 | 7/1968 | Findlay et al. | 117/36.1 |
| 3,484,508 | 12/1969 | Findlay | 264/45 |
| 3,666,947 | 5/1972 | Haas et al. | 250/83 R |
| 3,930,099 | 12/1975 | Gregson | 428/315 |
| 3,969,264 | 7/1976 | Davis | 252/299 |
| 3,974,317 | 8/1976 | Sharpless | 428/215 |
| 4,022,706 | 5/1977 | Davis | 252/299 |
| 4,046,073 | 9/1977 | Mitchell et al. | 101/426 |
| 4,321,286 | 3/1982 | Scott et al. | 427/152 |
| 4,543,313 | 9/1985 | Mahabadi et al. | 430/109 |
| 4,544,292 | 10/1985 | Kohle et al. | 400/241.2 |
| 4,624,881 | 11/1986 | Shini | 428/207 |
| 4,803,119 | 2/1989 | Duff et al. | 428/321.3 |
| 5,024,989 | 6/1991 | Chiang et al. | 428/913 |

FOREIGN PATENT DOCUMENTS

| | | | |
|---|---|---|---|
| 0254420 | 1/1988 | European Pat. Off. | 427/152 |

*Primary Examiner*—Pamela R. Schwartz
*Attorney, Agent, or Firm*—Judith L. Byorick

[57] ABSTRACT

Disclosed is a thermal transfer printing element which comprises a substrate upon which is situated an ink composition comprising a liquid crystalline material and a colorant. Diluent materials can also be contained in the ink. Also disclosed is a process for forming images with a thermal transfer printing apparatus which comprises incorporating into a thermal transfer printing apparatus a thermal transfer element which comprises a substrate upon which is situated an ink composition comprising a liquid crystalline material and a colorant and applying heat imagewise to the substrate to transfer ink imagewise from the substrate to a receiver sheet.

31 Claims, No Drawings

THERMAL TRANSFER PRINTING ELEMENTS WITH MESOMORPHIC INKS

BACKGROUND OF THE INVENTION

The present invention relates to ink compositions useful for thermal transfer printing processes. More specifically, the present invention is directed to thermal transfer elements with inks containing mesomorphic materials, primarily those molecules and polymers that exhibit liquid crystalline behavior.

Thermal printing is a nonimpact printing process that enables formation of high resolution images. These printing processes are simple, offer low noise levels, and are very reliable over extended usages. Thermal printing processes may be classified into three categories. Direct thermal printing entails the imagewise heating of special papers coated with heat sensitive dyes, such that an image forms in the heated areas. Another method of thermal printing is known as the dye transfer or dye sublimation technique, and operates by heating a transfer element coated with a sublimable dye, which transfer element is not in contact with the receiving substrate. When the transfer element is imagewise heated, the dye sublimates and migrates to the receiver sheet, which possesses a polymeric coating into which the dye diffuses, forming an image. A third method of thermal printing is known as thermal transfer printing. The thermal transfer printing process entails imagewise heating of a transfer element containing ink, which transfer element is in intimate contact with the heater on one side and the receiving substrate on the other side. Imagewise heating of the transfer element affects the ink in such a way as to cause it to transfer from the transfer element to the receiving substrate, thereby resulting in image formation. Thermal transfer printing methods generally employ uncoated plain papers, which enables prints with acceptable appearance and excellent archival properties. In addition, the thermal transfer printing method can be employed for color printing applications by using transfer elements of the desired color or colors.

Thermal transfer printing processes generally employ a thermal printhead, a transfer element, and a receiver sheet. The side of the transfer element containing the ink is placed in contact with the receiver sheet, and heat originating from the printhead is then applied to the transfer element. Heat conducted through the transfer element increases the temperature of the ink, which may cause it to melt, soften, decrease in viscosity, or otherwise undergo a transition that enables the ink to transfer to the receiver sheet. After the receiver sheet and transfer element are separated, an image remains on the receiver sheet. An alternative method of heating the transfer element, known as resistive heating, employs an array of electrodes instead of thermal printhead to generate a current between the electrodes and a grounded conductive layer in the transfer element. This method is described in the *IBM Journal of Research & Development*, Vol. 29, No. 5, 1985, the disclosure of which is totally incorporated herein by reference. Additional information concerning thermal transfer printing processes is disclosed in *Thermal Transfer Printing: Technology, Products, Prospects*, published by Datek Information Services, P.O. Box 68, Newtonville, MA, the disclosure of which is totally incorporated herein by reference.

The thermal transfer printing process has been disclosed in, for example, U.S. Pat. No. 3,441,940 and U.S. Pat. No. 3,745,586, the disclosures of each of which are totally incorporated herein by reference. In addition, augmented thermal transfer printing processes are known. For example, U.S. Pat. No. 3,989,131 discloses a pressure assisted thermal transfer printing process employing an electrothermic printing unit for writing dot matrix characters on a printing line of recording medium by means of an electrothermal printing head which is continually movable along the printing line. Pressure is interposed between the head and the recording medium, pressure means being provided for pressing the printing elements against the transfer element and the receiver sheet. In addition, U.S. Pat. No. 4,541,042 discloses a transfer recording process assisted by a solvent, wherein a receiving medium such as paper and an ink transfer sheet are placed in contact between a platen and a thermal head, and a liquid, volatile solvent is applied to the paper. The solvent enables high speed thermodissolving transfer of the ink to the paper by heating selected areas to form an image.

Further, U.S. Pat. No. 4,525,722, discloses a thermal transfer printing process assisted by chemical heat amplification, wherein some of the heat necessary for melting and transferring the ink from a solid fusible layer in a ribbon to a receiving medium is provided by an exothermic reaction involving an exothermic material contained in a layer in the ink ribbon. Also, U.S. Pat. No. 4,549,824 discloses a thermal transfer printing process aided by an exothermic reaction, wherein an aromatic azido compound is added to the ink, said azido compound being one that exotherms at the conditions of thermal ink transfer. In addition, U.S. Pat. No. 4,550,324 discloses an ink transfer thermal printer utilizing a thermosensitive ink that is solid at normal temperatures, with selected portions of the ink being liquefied by heating and transferred onto recording paper. The printer can be of either contact or non-contact (ink jet) configuration, and eliminates the need to utilize disposable materials such as ink ribbons.

U.S. Pat. No. 4,567,489 discloses a thermal printhead for a thermographic printer having an electrically insulating substrate on which resistors are placed that form impression points and current supply and current discharge leads bonded to the resistors. The printhead includes a structure for forming a magnetic field that acts on the resistors in the immediate proximity of the resistors and along the resistor print line. The magnetic field is directed such that when the current flows through the resistors, the current paths are deflected upward into the upper part of the resistor on its outer surface. The single resistor impression points thus reach their highest temperature at the printing surface where they must deliver heat to the recording medium, which results in the heat needed for heating the resistor being supplied more quickly to the recording medium, thereby reducing the cooling time of the single resistor impression point so that a higher printing velocity can be attained with the thermal printhead.

Additionally, U.S. Pat. No. 4,510,511 discloses a picture recording method and apparatus using an ink containing an evaporable coloring matter, which enables printing on a medium without an ink ribbon. The special ink is supplied to an ink transporting means and then cooled below the melting point of the ink bonding agent. A discharge energy is applied, controlled according to the picture to be formed, which causes the coloring matter to fly to the recording medium opposite the transporting means. Essentially, the process entails fluidizing a marking material by heat, picking up the liquid marking material on a gravure type roll, and selectively transferring it to the receiving sheet by means of a high voltage field.

U.S. Pat. No. 4,046,073, the disclosure of which is totally incorporated herein by reference, discloses a printing or copying system in which ink is transferred from an ink-bearing medium, which can be a porous medium filled with ink in the pores, to a printing medium through the use of ultrasonics. The ink bearing medium is placed in contact with the paper and ultrasonic energy is applied to the medium, causing the ink to decrease in viscosity due to ultrasonic vibrations and conversion of ultrasonic energy into heat. The ink is then transferred to a printing medium. In addition, European Patent Application 0,254,420 discloses a recording method wherein a recording member generally in the form of a cylinder and having on its outer surface one or more porous layers impregnated with ink is heated on the outer surface in image configuration. Ink contained in the cylinder is thus brought to the surface of the imaging member and transferred to a recording sheet in imagewise fashion.

Further, U.S. Pat. No. 4,803,119, the disclosure of which is totally incorporated herein by reference, discloses ink coating compositions for impact typewriter ribbons, which ink coatings comprise a sponge material having dispersed therein an ink comprising pigment particles and a dimer acid. Further, U.S. Pat. No. 3,348,651, the disclosure of which is totally incorporated herein by reference, discloses pressure sensitive ink transfer ribbons, tapes, and sheets having a microporous inking composition for use in typewriters, high speed printers, and optical scanning devices. The pressure sensitive ink transfer medium comprises a shock-absorbent base layer of an elastomeric polymer film having a high degree of resiliency in a direction normal to the plane of the film, an intermediate layer of a thin, non-elastic polymer film bonded to the base layer, and an inking layer bonded to the intermediate layer over substantially its entire working surface and comprising a substantially continuous film of a microporous inking composition. The microporous inking composition consists essentially of a uniformly blended mixture of an elastomeric polymeric binder, an inking compound comprising a non-aqueous, non-volatile ink carrier which is substantially insoluble in the elastomeric polymeric binder and which contains a high concentration of an ink pigment, and a finely ground microporous inorganic filler. Other patents, such as U.S. Pat. Nos. 3,287,153, 3,392,042, 3,484,508, 3,930,099, 4,321,286, 4,544,292, and 4,624,881, also disclose pressure sensitive porous marking ribbons filled with an exudable marking material. In addition, U.S. Pat. Nos. 3,351,948, 3,847,265, 4,251,276, 4,414,555, 4,415,903, 4,603,986, 4,608,577, 4,762,734, 3,480,962, 4,128,345, 4,205,320, and U.S. Pat. No. 4,315,267 are of background interest.

One problem encountered in thermal transfer printing is the necessity of imagewise heating the ink, which typically comprises a crystalline wax, through the melting phase. The latent heat of melting and the time necessary for heat transfer for this melting phase change places both power and speed constraints on the thermal transfer printing process, which constraints influence printer performance and manufacturing cost. Replacing the ink containing a crystalline wax, which requires crystalline melting, with an ink of the present invention, which can be transferred to a substrate by means of a mesomorphic transition, will improve upon these shortcomings, since mesomorphic transitions typically require far less heat to image a pixel or pixels selectively.

For example, the heat of fusion of a typical paraffin or long chain aliphatic hydrocarbon wax is approximately 39 kilocalories per gram, while the heat of mesomorphic transition of a typical liquid crystalline material such as p,p'-azoxyanisole is approximately 0.7 kilocalorie per gram. Typically, thermal transfer printing processes entail heating the transfer element from room temperature of about 20° C. to a temperature of from about 40° to about 95° C. Thus, heating one gram of a paraffin wax with a heat capacity of about 0.5 kilocalorie per degree Celsius per gram from 20° C. to 60° C. requires about 59 kilocalories per gram, melting the wax at that temperature requires about 39 kilocalories per gram, and heating the melted wax from 60° C. to 70° C. requires an additional 5 kilocalories per gram, for a total energy requirement of about 64 kilocalories per gram. In comparison, heating one gram of a liquid crystalline material such as p,p'-azoxyanisole with a heat capacity of about 0.5 kilocalorie per degree Celsius per gram from 20° C. to 60° C. requires about 20 kilocalories per gram, inducing a mesomorphic transition in the liquid crystalline material at that temperature requires about 0.7 kilocalorie per gram, and heating the material from 60° C. to 70° C. requires an additional 5 kilocalories per gram, for a total energy requirement of about 25.7 kilocalories.

When a liquid crystalline material is heated and undergoes a mesomorphic transition, its viscosity can drop by as much as five orders of magnitude (e.g. from about 100,000 centipoise to about 10 centipoise) during the process of a mesomorphic change occurring over a 10° C. temperature range. Thus, imagewise heating of a transfer element containing materials that undergo mesomorphic transitions will result in a change in the material's rheological properties sufficient to effect imagewise transfer of the ink to a receiver sheet.

Ink compositions containing liquid crystalline materials are suitable for use in conjunction with both single use ink transfer elements and multi-use ink transfer elements. Multi-use thermal transfer elements such as those disclosed in copending application U.S. Ser. No. 454,800; the disclosure of which is totally incorporated herein by reference, generally require more energy to heat than do single use transfer elements since they possess a layer of sponge material within which the ink is contained, in addition to a supporting substrate, and also contain more ink than do single use elements in order to enable multiple uses. Accordingly, providing a thermal transfer ink composition that requires less heat to enable image formation than that required by conventional thermal transfer inks provides more energy efficient imaging. Ink compositions with lowered heating requirements also enable the provision of multi-use elements with thicker sponge layers, since although heat dissipates as it passes through the thick sponge layer, enough heat passes to effect the necessary mesomorphic transition of the ink. Thicker sponge layers are desirable in multi-use transfer elements since the sponge contains the ink; providing more sponge material provides a transfer element containing more ink, which results in a longer useful lifetime for the multi-use transfer element.

Ink compositions containing liquid crystalline materials are known. For example, U.S. Pat. Nos. 3,969,254 and 4,022,706, the disclosures of each of which are totally incorporated herein by reference, disclose cholesteric liquid crystal water base inks. Films formed from these inks can be used as temperature indicators and ornamental articles, and can also be used for photograph reproduction by irradiating through a negative placed on the film such that the exposed areas of the film undergo a temperature response change which is stable for long periods of time. Typically, the inks comprise an oil in water latex, a small amount of organic solvent, which is usually polar and moderately water soluble, liquid crystals, a thickening agent, and, optionally, a wetting agent.

In addition, U.S. Pat. No. 3,974,317, the disclosure of which is totally incorporated herein by reference, discloses thermometric compositions for recording changes in temperature which comprise a cholesteric liquid crystal system and a chemically inert substance immiscible with the crystal system. Varying the amount of the inert substance in the composition varies the temperature at which a predictable phase change to the isotropic phase occurs. All compositions in a particular product have the same color and exhibit the same color change.

Further, U.S. Pat. No. 3,666,947, the disclosure of which is totally incorporated herein by reference, discloses a liquid crystal imaging system employing an imaging member with a composition having a cholesteric liquid crystalline phase, with a radiation absorptive material dispersed throughout the liquid crystalline material. The imaging member is thermally imaged by heating portions of the material. The imaging members can also be erased by application of external forces, such as electric or magnetic fields.

Although the materials and processes in the prior art are suitable for their intended purposes, a need continues to exist for ink compositions suitable for use in thermal transfer printing processes. In addition, a need exists for thermal transfer printing elements that enable printing with reduced energy consumption. Further, a need exists for ink compositions suitable for use both in thermal transfer printing processes employing multi-use transfer elements and in thermal transfer printing processes employing single use transfer elements. There is also a need for transfer elements suitable for thermal transfer printing processes that require low amounts of applied heat to effect transfer to a substrate. In addition, there is a need for thermal transfer printing elements that enable rapid and inexpensive thermal transfer printing processes. Further, a need exists for thermal transfer printing elements that enable generation of high quality prints on plain paper.

SUMMARY OF THE INVENTION

It is an object of the present invention to provide ink compositions suitable for use in thermal transfer printing processes.

It is another object of the present invention to provide thermal transfer printing elements that enable printing with reduced energy consumption.

It is still another object of the present invention to provide ink compositions suitable for use both in thermal transfer printing processes employing multi-use transfer elements and in thermal transfer printing processes employing single use transfer elements.

It is yet another object of the present invention to provide transfer elements suitable for thermal transfer printing processes that require low amounts of applied heat to effect transfer to a substrate.

Another object of the present invention is to provide thermal transfer printing elements that enable rapid and inexpensive thermal transfer printing processes.

Still another object of the present invention is to provide thermal transfer printing elements that enable generation of high quality prints on plain paper.

These and other objects of the present invention are achieved by providing a transfer element which comprises a substrate upon which is situated an ink composition comprising a liquid crystalline material and a colorant. The ink composition can also contain optional ingredients, such as diluents, antioxidants, smudge resistance additives, and dispersants.

Included in the ink compositions of the transfer elements of the present invention are mesomorphic materials that undergo a mesomorphic phase change upon being heated to the aforementioned temperature range, such as liquid crystalline molecules and polymers. The phase change can constitute either a transition from the solid state to the smectic or nematic state, or a transition from the smectic or nematic state to the liquid state. In general, liquid crystalline materials are those in which the molecules are oriented so that ionic, hydrogen, and/or steric bonding occurs between the individual molecules. As the material is heated, these bonds break, and the molecules slide past each other. Subsequent to the mesomorphic transition, the materials suitable for the present invention generally exhibit a viscosity of from about 3 to about 50,000 centipoise. Further information concerning liquid crystalline materials is disclosed in *Liquid Crystals: The Fourth State of Matter*, Franklin D. Saeva, ed., Marcel Dekker, Inc., New York and Basel (1979) and *Liquid Crystals: Their Physics, Chemistry and Applications*, C. Hilsum and E. P. Raynes, eds., The Royal Society, London (1983), the disclosures of each of which are totally incorporated herein by reference.

Some examples of classes of materials that exhibit liquid crystalline behavior include 4,4'-di-n-alkoxyazoxybenzenes, p-alkoxybenzoic acids, 4,4'-di-n-alkoxyphenylnitrones, 4-benzylideneamino-4'-methoxybiphenyls with aromatic or heterocyclic functionalities, Schiff's bases, diphenylacetylides, cholesteryl esters, carbonates, S-alkyl carbonates, ω-phenyl alkanoates, thiocholesteryl-ω-phenylalkanoates, and the like.

Examples of suitable liquid crystalline materials include members of the azoxyanisole family exhibiting liquid crystalline behavior, such as esters of azoxyanisole, including those with the following formula:

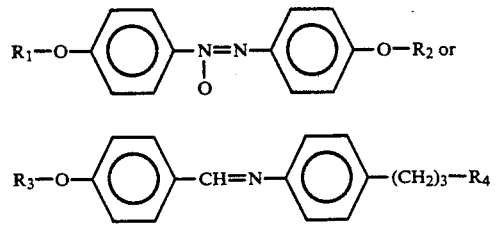

wherein $R_1$, $R_2$, $R_3$, and $R_4$ are independently selected from the group consisting of aliphatic hydrocarbon groups with from about 1 to about 30 carbon atoms, and preferably from about 1 to about 25 carbon atoms. $R_1$, $R_2$, $R_3$, and $R_4$ can also be substituted hydrocarbon groups, such as halogenated hydrocarbons, esterified hydrocarbons, and the like, as well as any combination and/or mixture thereof. Accordingly, examples of liquid crystalline materials from the azoxyanisole family include, but are not limited to, methyl azolyanisole, ethyl azoxyanisole, propyl azoxyanisole, butyl azoxyanisole, pentyl azoxyanisole, hexyl azoxyanisole, heptyl azoxyanisole, octyl azoxyanisole, nonyl azoxyanisole, decyl azoxyanisole, undecyl azoxyanisole, dodecyl azoxyanisole, tridecyl azoxyanisole, tetradecyl azoxyanisole, pentadecyl azoxyanisole, hexadecyl azoxyanisole, heptadecyl azoxyanisole, octadecyl azoxyanisole, nonadecyl azoxyanisole, and the like as well as mixtures thereof. Additional examples of suitable liquid crystalline materials include members of the cholesterol family, such as esters of cholesterol, including those of the formula:

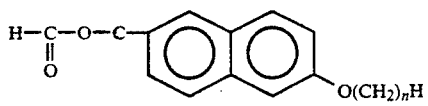

wherein n is a number of from about 1 to about 25 carbon atoms, although the number of carbon atoms can exceed this range provided that the objectives of the present invention are achieved. Accordingly, examples of liquid crystalline materials from the azoxyanisole family include, but are not limited to, dimethyl azoxyanisole, diethyl azoxyanisole, dipropyl azoxyanisole, dibutyl azoxyanisole, dipentyl azoxyanisole, dihexyl azoxyanisole, diheptyl azoxyanisole, dioctyl azoxyanisole, dinonyl azoxyanisole, didecyl azoxyanisole, diundecyl azoxyanisole, didodecyl azoxyanisole, ditridecyl azoxyanisole, ditetradecyl azoxyanisole, dipentadecyl azoxyanisole, dihexadecyl azoxyanisole, diheptadecyl azoxyanisole, dioctadecyl azoxyanisole, dinonadecyl azoxyanisole, or the like, as well as mixtures thereof. For these two classes of liquid crystalline materials, the temperature at which the mesomorphic transition occurs rises as the number of carbon atoms in the hydrocarbon substituent increases. Other examples of suitable liquid crystalline materials for the inks of the present invention include benzoates exhibiting liquid crystalline behavior; naphthates exhibiting liquid crystalline behavior; cinnamates exhibiting liquid crystalline behavior, such as the homologous series of di-n-alkyl p-azoxy-α-methylcinnamates of the formula

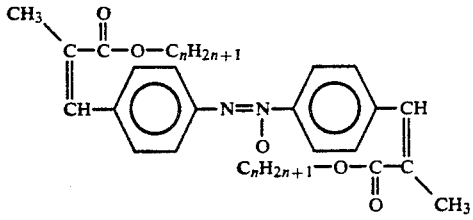

wherein n is a number of from about 2 to about 12, n-hexyl-4-(4'-phenylbenzylideneamino) cinnamate, and the like; pyrimidines, such as 2-(4-n-alkylphenyl)-5-(4-n-alkyloxyphenyl)pyrimidine, wherein n-alkyl has from about 1 to about 25 carbon atoms; benzilidine anilines, such as N-(4-n-alkyloxybenzylidene)-4'-n-alkylanilines, wherein n-alkyl has from about 2 to about 12 carbon atoms and preferably from about 4 to about 7 carbon atoms; cellulosic materials exhibiting liquid crystalline behavior, such as hydroxypropyl cellulose; 4,4'-di-n-alkoxyazoxybenzenes of the formula $$C_nH_{2n+1}—O—C_6H_4—N{=}NO—C_6H_4—O—C_nH_{2n+1}$$

wherein n is a number of from about 1 to about 15; 4-n-alkoxybenzoic acids of the formula $$C_nH_{2n+1}—O—C_6H_4—COOH$$

wherein n is a number of from about 1 to about 15; bis-(4'-n-alkoxybenzal)-2-chloro-1,4-phenylenediamines of the formula $$C_nH_{2n+1}—O—C_6H_4—CH{=}N—C_6H_3Cl—N{=}CH—C_6H_4—O—C_nH_{2n+1}$$

wherein n is a number of from about 1 to about 15; 4-n-butyloxybenzal-4'-alkylanilines of the formula $$C_4H_9—O—C_6H_4—CH{=}N—C_6H_4—C_nH_{2n+1}$$

wherein n is a number of from about 1 to about 15 and preferably from about 2 to about 8; materials of the formula

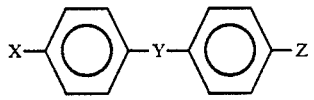

wherein X and Z are independently selected from the group consisting of

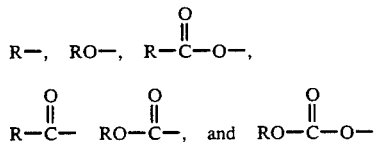

with R being an alkyl group with from 1 to about 25 carbon atoms, and Y is selected from the group consisting of

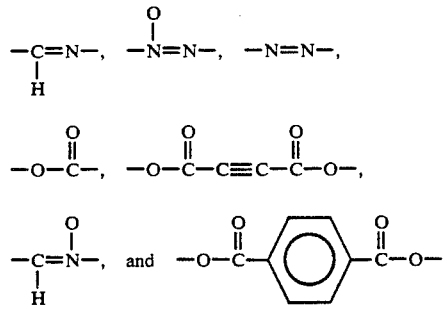

and the like, as well as mixtures thereof. Further information regarding the synthesis and characterization of many of these materials is disclosed in, for example, D. Demus et al., *Mol. Cryst. Liq. Cryst.*, 15:161 (1971); M. J. Billard, *C.R. Acad. Sci., Paris*, Ser. A.B., B280:573 (1975); G. W. Smith et al., *J. Chem. Phys.*, 59:3214 (1973); H. Arnold et al., *Z. Phys. Chem.*, 240:185 (1969); J. A. Castellano et al., *J. Org. Chem.*, 33:3501 (1968); S. L. Arora et al., *J. Org. Chem.*, 35:1705 (1970); W. R.

Young, Mol. *Cryst. Liq. Cryst.*, 10:237 (1970); J. P. Schroeder et al., *J. Org. Chem.*, 33:591 (1968); H. Kelker et al., *Angew. Chem.*, 81:903 (1969); H. Kelker et al., *Angew. Chem.*, 82:984 (1970); J. B. Flannery et al., *J. Phys. Chem.*, 74:3611 (1970); D. L. Fishel et al., *Chem. Commun.*, 1557 (1971); W. R. Young et al., *J. Amer. Chem. Soc.*, 94:3976 (1971); W. R. Young et al., *Angew. Chem.* (Int. Ed.) 10:410 (1971); L. E. Knaak et al., *Mol. Cryst. Liq. Cryst.*, 17:171 (1971); H. Hirata et al., *Mol. Cryst. Liq. Cryst.*, 20:343 (1973); L. Verbit et al., *Mol. Cryst. Liq. Cryst.*, 17:49 (1972); F. Jones et al., *J. Chem. Soc. Chem. Commun.*, 841 (1973); J. P. Van Meter et al., *Mol. Cryst. Liq. Cryst.*, 32:271 (1973); R. Steinstrasser, *Angew. Chem.*, 84:636 (1972); D. C. Schroeder et al., *J. Amer. Chem. Soc.*, 96:4347 (1974); W. R. Young et al., *Mol. Cryst. Liq. Cryst.*, 26:7 (1974); J. P. Van Meter et al., *Mol. Cryst. Liq. Cryst.*, 32:285 (1973); J. P. Van Meter et al., *J. Amer. Chem. Soc.*, 95:626 (1973); and L. Verbit et al., *Mol. Cryst. Liq. Cryst.*, 30:201 (1975), the disclosures of each of which are totally incorporated herein by reference.

Suitable liquid crystalline or mesomorphic materials also include polymers that exhibit liquid crystalline behavior. Polymers of this type generally are of two types. The first type consists of polymers having long side chains that exhibit liquid crystalline behavior, such as cholesteric groups, groups with six-membered aliphatic or aromatic rings such as phenyl groups, cyclohexenyl groups, or the like, wherein the flat-sided chains interact in liquid crystalline fashion. The liquid crystalline interactions between the side chains of these polymers are analogous to crosslinking. As the temperature increases, these interactions cease to occur, and the polymeric material changes from a state similar to a crosslinked material to a state analogous to a material with no crosslinking at all as the temperature increases to the mesomorphic transition temperature. The mesomorphic transition results in the viscosity of these polymeric materials undergoing a relatively sharp drop of from about 100,000 to about 10 centipoise over a temperature interval of from about 2° to about 50° C.

The second type of polymer exhibiting liquid crystalline behavior consists of polymers wherein the backbone or chain portion exhibits liquid crystalline behavior. Examples of polymers of this type include polyazoxyanisole, various polyesters, and polysiloxanes such as polydiethyl siloxane. In polymeric materials of this type, the repeating units of the polymeric chains attract each other, forming a highly crosslinked composition. Upon heating the material to the mesomorphic transition temperature, the crosslinking interactions are broken, and the viscosity of the material drops sharply, going from about 100,000 to about 10 centipoise over a temperature interval of from about 2° to about 50° C. Some materials of this type, however, tend to have a relatively high viscosity of about 10,000 centipoise even after undergoing the mesomorphic transition, having a consistency comparable to the coatings on adhesive tapes. Accordingly, some materials of this type may be less suitable for use in multi-use thermal transfer elements. In single use thermal transfer elements, however, materials of this type can be used since they will become sticky upon heating, and imagewise heating of a transfer element having an ink containing one or more of these materials can result in imagewise transfer of the ink to the receiver sheet by means of the ink adhering to the receiver sheet.

Additional examples of suitable liquid crystalline materials include polybenzamides, such as that of the formula

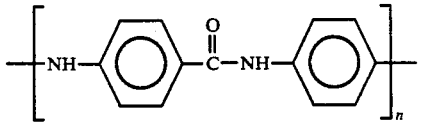

wherein n represents the number of repeating units, as disclosed in, for example, P. W. Morgan, *Polymer Preprints*, 17:47 (1976), E. T. Samulski in *Liquid Crystalline Order in Polymers*, A. Blumstein, ed., Academic Press, New York (1978), and E. Lizuka, *Adv. Polym. Sci.*, 20:79 (1976), the disclosures of each of which are totally incorporated herein by reference; polybenzyl-y-L-glutamate of the formula

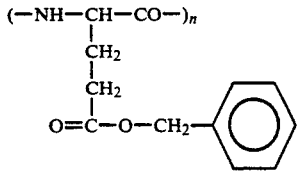

wherein n represents the number of repeating units, as disclosed in, for example, G. W. Gray, *Molecular Structure and the Properties of Liquid Crystals*, Academic, New York (1962) and J. M. Stein, "Molecular Associations in Biological and Related Systems", *Advances in Chemistry Series*, No. 84, American Chemical Society, Washington, D.C. (1969), the disclosures of each of which are totally incorporated herein by reference; poly(biphenyl acrylates), as disclosed in, for example, M. Baccaredda et al., *Polym. Lett.*, 9:303 (1971), B. A. Newman et al., *Adv. Polym. Sci. Eng. Proc. Symp.*, 21 (1972), and P. L. Magagnini et al., *Eur. Polym. J.*, 10:585 (1974), the disclosures of each of which are totally incorporated herein by reference; liquid crystalline polycarbonates of the formula

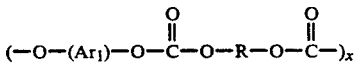

wherein $Ar_1$ is selected from the group consisting of

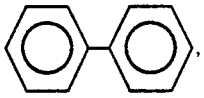

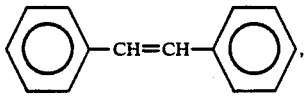

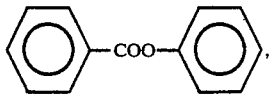

-continued

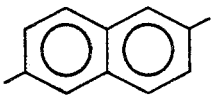
, and

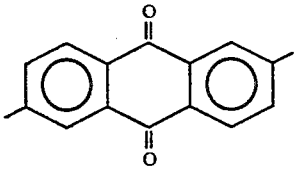

and R is selected from the group consisting of $(CH_2)_n$ $-(CH_2)_2-O-(CH_2)_2)-$ and $-(CH_2)_2-O-(CH_2)_2-O-(CH_2)_2)-$ with n being a number of from about 4 to about 12 and x representing the number of repeating units, generally being from about 5 to about 1,000, as disclosed in U.S. Pat. No. 4,543,313, the disclosure of which is totally incorporated herein by reference; liquid crystalline copolycarbonates of the formula

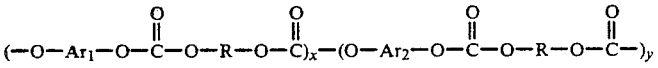

wherein $Ar_1$ is selected from the group consisting of

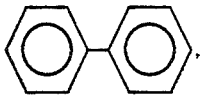
,

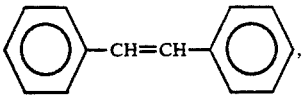
,

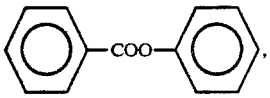
,

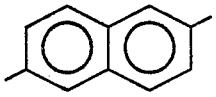
, and

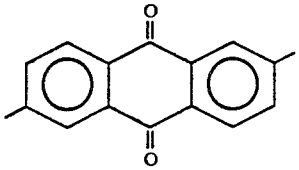

$Ar_2$ is selected from the group consisting of

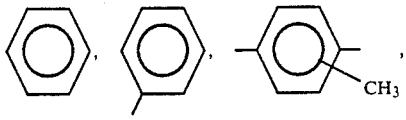
,

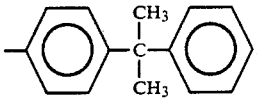
, and

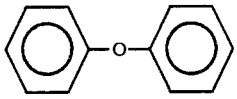

and R is selected from the group consisting of $(CH_2)_n$ $-(CH_2)_2-O-(CH_2)_2)-$ and $-(CH_2)_2-O-(CH_2)_2-O-(CH_2)_2)-$ with n being a number of from about 4 to about 12 and x and y representing the number of repeating units, generally each being from about 5 to about 1,000, as disclosed in U.S. Pat. No. 4,543,313; liquid crystalline polyurethanes of the formula

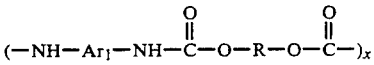

wherein $Ar_1$ is selected from the group consisting of

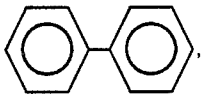
,

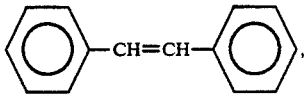
,

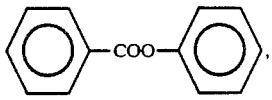
,

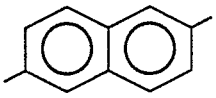
, and

-continued

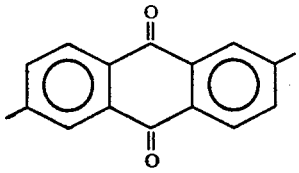

and R is selected from the group consisting of $(CH_2)_n$ $-(CH_2)_2-O-(CH_2)_2)-$ and $-(CH_2)_2-O-(CH_2)_2-O-(CH_2)_2)-$ with n being a number of from about 4 to about 12 and x representing the number of repeating units, generally being from about 5 to about 1,000, as disclosed in U.S. Pat. No. 4,543,313; liquid crystalline polyesters of the formula $$(-O-Ar_1-O-\overset{O}{\overset{\|}{C}}-R-\overset{O}{\overset{\|}{C}}-)_x$$

wherein $Ar_1$ is selected from the group consisting of

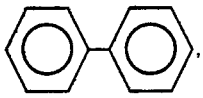

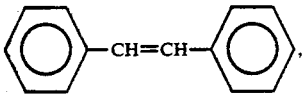

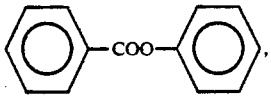

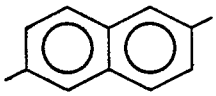

, and

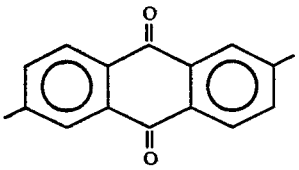

and R is selected from the group consisting of $(CH_2)_n$ $-(CH_2)_2-O-(CH_2)_2)-$ and $-(CH_2)_2-O-(CH_2)_2-O-(CH_2)_2)-$ with n being a number of from about 4 to about 12 and x representing the number of repeating units, generally being from about 5 to about 1,000, as disclosed in U.S. Pat. No. 4,543,313; liquid crystalline copolyesters of the formula $$(-O-Ar_1-O-\overset{O}{\overset{\|}{C}}-R-\overset{O}{\overset{\|}{C}})_x(O-Ar_2-O-\overset{O}{\overset{\|}{C}}-R-\overset{O}{\overset{\|}{C}})_y$$

wherein $Ar_1$ is selected from the group consisting of

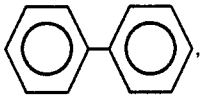

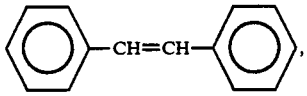

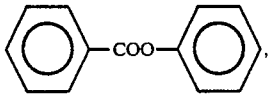

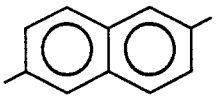

, and

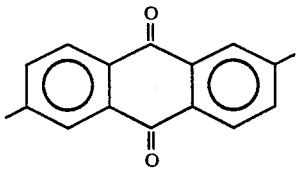

$Ar_2$ is selected from the group consisting of

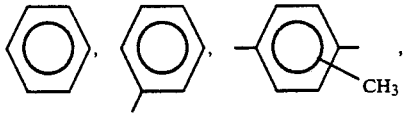

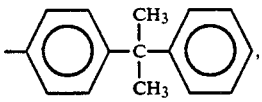

and

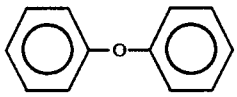

and R is selected from the group consisting of $(CH_2)_n$ $-(CH_2)_2-O-(CH_2)_2)-$ and $-(CH_2)_2-O-(CH_2)_2-O-(CH_2)_2)-$ with n being a number of from about 4 to about 12 and x and y representing the number of repeating units, generally each being from about 5 to about 1,000, as disclosed in U.S. Pat. No. 4,543,313; and liquid crystalline materials as disclosed in U.S. Pat. No. 4,617,371, U.S. Pat. No. 4,729,847, U.S. Pat. No. 4,774,160, U.S. Pat. No. 3,907,559, U.S. Pat. No. 3,732,119, and U.S. Pat. No. 4,394,498, the disclosures of which are totally incorporated herein by reference. Liquid crystalline polymers and processes for the preparation thereof are also disclosed in U.S. Pat. No. 4,973,539, U.S. Ser. No. 07/403,265 (now abandoned), U.S. Pat. No. 5,006,170, and U.S. Pat. No. 4,891,293 the disclosures of each of which are totally incorporated herein by reference.

Ink compositions of the transfer elements of the present invention contain the mesomorphic material in an effective amount, typically from about 10 to about 75 percent by weight, and preferably from about 10 to about 40 percent by weight. The ink can also contain a diluent in an effective amount, generally from 1 to about 90 percent by weight. The amount of the mesomorphic or liquid crystalline material chosen generally depends on the compatibility of the mesomorphic material with the selected dye or pigment, with compatibility referring to how well a selected dye can be dissolved in the material or how well a selected pigment can be suspended in the material. In addition, since mesomorphic materials are often expensive, this component of the inks of the present invention can be diluted with similar molecules, such as fatty acids containing up to about 20 carbon atoms and preferably being saturated. Also suitable as diluents are unsaturated alcohols, glycols, esters of fatty acids, unsaturated fatty acids, and other similar materials having long carbon chains, to enhance compatibility with the liquid crystalline materials, and some degree of polarity, such as that provided by an —OH or —OR group to improve solubility of the diluent in the mesomorphic material. Waxes are also suitable diluent materials, and include materials such as carnauba wax, paraffin waxes, polyethylene waxes, polypropylene waxes, ester waxes such as beeswax, ethylene vinyl acetate copolymers such as Elvax ® 410 available from E. I. Du Pont de Nemours & Company, and the like as well as mixtures thereof.

The inks in the transfer elements of the present invention also contain a colorant, such as a pigment, a dye, or combinations thereof, in an effective amount, generally from about 2 to about 25 percent by weight, and preferably from about 3 to about 10 percent by weight. Suitable pigments or dyes include carbon black, nigrosine dye, aniline blue, magnetites and mixtures thereof. When the pigment particles are magnetites, which comprise a mixture of iron oxides ($Fe_2O_3.Fe_3O_4$) such as those commercially available as Mapico Black, these pigments are generally present in the ink composition in an amount of from about 2 percent by weight to about 30 percent by weight, although amounts outside of this range can be present. If magnetite is present in amounts of from about 2 to about 30 percent by weight, the images formed as a result of the thermal transfer printing process employing inks of the present invention can be used for applications wherein magnetically readable images are desirable, such as magnetically readable bar codes and magnetically encoded checks.

Colored pigments and dyes are also suitable for use in the ink of the transfer elements of the present invention, including red, green, blue, brown, magenta, cyan, and yellow particles, as well as mixtures thereof. Illustrative examples of suitable magenta colorants include 2,9-dimethyl-substituted quinacridone and anthraquinone dye, identified in the Color Index as Cl 60710, Cl Dispersed Red 15, a diazo dye identified in the Color Index as Cl 26050, Cl Solvent Red 19, and the like. Illustrative examples of suitable cyan colorants include copper tetra-4-(octadecyl sulfonamido) phthalocyanine, X-copper phthalocyanine pigment, listed in the Color Index as Cl 74160, Cl Pigment Blue, and Anthradanthrene Blue, identified in the Color Index as Cl 69810, Special Blue X-2137, and the like. Illustrative examples of suitable yellow colorants include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. Other colorants can be employed.

The ink compositions for the transfer elements of the present invention can also contain an optional anti-oxidant component, such as BHA or BHT or other known free radical scavenger materials, present in an effective amount, generally from 0.01 to about 0.5 percent by weight, and preferably from about 0.02 to about 0.5 percent by weight. In addition, the ink compositions of the present invention can contain an optional additive to prevent image smudging, such as a glycol, including polyethylene glycol, or polyethylene oxide, present in an effective amount, generally from about 10 to about 88 percent by weight of the ink. When the ink includes a pigment colorant, a dispersant such as a surfactant can also be included in an effective amount, generally from about 0.5 to about 5 percent by weight. Suitable dispersants include known dispersing agents such as Sulfonated Hydrocarbon - Petronate #9, available from Witco Chemical Company, Petrolite WB14, available from Bareco Div. of Petrolite Corporation, and the like.

When a single use thermal transfer element is desired, the ink composition can be prepared by blending all of the ingredients together at once at a temperature at or above the mesomorphic transition point or the melting point of the liquid crystalline component of the ink, typically from about 20° to about 100° C., and preferably at about 50° C., although the blending temperature can be outside of this range if desired. When a diluent component has a melting temperature higher than the mesomorphic transition point or the melting point of the liquid crystalline ink component, the ink ingredients are mixed at or above the melting temperature of the diluent. After the ingredients are mixed together, they are blended in an attritor, which can be a vertical ball mill, a high shear mixer, or any other suitable attriting device, for an effective period, typically about 2 hours. Generally, when a pigment is the selected colorant, a ball mill is preferred to grind the pigment particles to a size suitable to enable suspension of the particles in the ink and to allow for the adsorption of any surfactants present onto the particle surface, whereas when a dye is the selected colorant, a high shear mixer is sufficient.

Single use thermal transfer elements, of the type that can be employed only once by applying heat to a given area, can be prepared by applying a coating of the ink material to a selected substrate material in an effective thickness, typically from about 0.1 to about 0.5 micron thick. The coating can be performed by any suitable process, such as hot melt coating, in which the ink composition is melted and maintained above the mesomorphic transition point of the liquid crystalline component of the ink, and applied to the substrate by knife coating, roll coating, solvent coating, extrusion coating, hot melt coating, or the like. The substrate can be of any suitable material such as glassine, polyester, Mylar®, Tedlar®, and the like. To alleviate the potential problem of the substrate adhering to the printhead, the substrate can be coated, on the side in contact with the heater and farthest from the printing substrate, with a release coating. Particularly preferred is a substrate of aluminized Mylar®, which consists of a layer of the Mylar® polyester coated with a layer of aluminum, typically about 1000 Angstroms thick. The aluminum prevents adhesion of the substrate to the printhead and accompanying problems, such as tearing or stretching of the transfer element, and also enhances heat transfer between the printhead and the transfer element. Other coating materials include polyesters, polyamides, polyvinylchloride, polyvinylacetate, polyurethanes, polyolefins, polyvinyl alcohols, silicone oils, waxes, graphite, and wax/polymer blends. The coating is of any effective thickness, preferably from about 0.05 to about 1 micron, although other thicknesses can be used.

Also preferred as substrates are condenser papers, also known as calendared papers, which are inexpensive, need no coating of a release material to prevent adhesion to the printhead, and also enhance heat transfer between the printhead and the transfer element. In addition, substrates of materials such as a polycarbonate filled with carbon black, as described in "Resistive Ribbon Thermal Transfer Printing: A Historical Review and Introduction to a New Printing Technology," *IBM J. Res. Develop.*, vol. 29, no. 5, pages 449 to 457 (1985), the disclosure of which is totally incorporated herein by reference, or other materials providing a suitable resistive heating base can be employed to permit use of the thermal transfer elements of the present invention in resistive heating thermal transfer printing, such as that performed in the IBM Quietwriter® family of printers. The substrate has an effective thickness, typically of from about 2 to about 15 microns, and preferably from about 3 to about 6 microns, although the thickness can be outside this range.

Multi-use transfer elements can be prepared according to the method described in detail in copending application U.S. Ser. No. 454,800, the disclosure of which is totally incorporated herein by reference.

Suitable substrates include those described for single use transfer elements, and are of an effective thickness, typically of from about 2 to about 5 microns, and preferably about 3 microns, although thickness can be outside this range. When a condenser paper substrate is present in a multi-use transfer element, an optional adhesive coating between the substrate and the sponge layer can prevent delamination of the sponge layer from the substrate. This adhesive coating can be of a material such as a polyvinyl chloride/polyvinyl acetate copolymer, including VYHH, available from Union Carbide Corporation, a polyester soluble in common organic solvents, such as Vitel® PE-222, available from Goodyear, a polyester such as Du Pont 49000 polyester adhesive, or the like. The coating material can be solvent coated onto the substrate from methyl ethyl ketone or a similar solvent by any suitable means, such as draw-down knife coating or gapped blade coating, followed by evaporation of the solvent with or without the application of heat, resulting in a coating thickness of from about 2 to about 3 microns. The substrate is coated with a layer of porous ink filled material to form a thermal transfer element of the present invention. This layer typically comprises from about 20 to about 80 percent by weight, preferably from about 20 to about 50 percent by weight, and more preferably about 30 percent by weight, of the sponge material, and from about 20 to about 80 percent by weight, preferably from about 50 to about 80 percent by weight, and more preferably about 70 percent by weight, of the ink composition. Suitable sponge materials include copolymers of polyvinyl chloride and polyvinyl acetate, such as those commercially available from Union Carbide Corporation as VYHH and VYHD, polyesters, such as Vitel® PE-222, commercially available from Goodyear Corporation, silicone polymers soluble in common organic solvents, polycarbonates, polysulfones, poly phenylene oxides and other organic polymers soluble in common solvents, urethanes, natural rubbers, synthetic rubbers, block copolymers of heat resistant monomers, such as alpha methyl styrene, which are soluble in common organic solvents, polyamides soluble in common organic solvents, such as Emerez®, commercially available from Emery Industries, and the like. In addition, elastomeric materials, such as the silicone elastomer available from Dow Corning as Sylgard 182 or an abhesive elastomer such as polydimethylsiloxane, can be employed; these materials contract upon heating, causing the ink to come to the surface of the porous layer in imagewise fashion and to transfer to the receiver sheet.

The porous layer is present in an effective thickness, typically of from about 12 to about 25 microns, and preferably about 21 to 22 microns, although this layer can have a thickness outside of this range. For the purposes of the present invention, a thicker sponge layer has desirable advantages in that the layer will be capable of holding more ink, thus enabling several uses of the transfer element. A porous layer of excessive thickness, however, will require more heat applied to the back of the transfer element to cause imagewise transfer of the ink to the receiving sheet, since the heat applied must pass through both the substrate and the porous layer. Transfer elements having a porous layer with a thickness in the aforementioned ranges are generally capable of multiple uses and generally do not present an excessive thermal burden. Ink compositions selected for multi-use thermal transfer elements preferably have a high concentration of colorant present, so that a small amount of the ink is sufficient to form an image.

The porous ink-filled layer of the thermal transfer elements of the present invention can be prepared by many methods. For example, a two solvent process can be employed, which process entails dissolving the polymeric sponge material in one solvent and the ink in another solvent. These solvents are chosen to be miscible with each other, and chosen so that the ink does not exhibit substantial solubility in the sponge solvent, and the sponge material does not exhibit substantial solubility in the ink solvent. The ink solvent is generally capable of evaporating at a lower temperature than the sponge solvent or has a lower boiling point than the sponge solvent at any given atmospheric pressure. A mixture is prepared by mixing a solution of the sponge material in its selected solvent with a solution of the ink in its selected solvent, with the sponge material and ink being present in relative amounts proportional to the ratio of ink to sponge desired in the coating. The mixture is then coated onto the substrate. Upon application of heat to the mixture, generally at a temperature equal to or greater than the boiling point of the ink solvent but lower than the boiling point of the sponge solvent, the ink solvent evaporates first, leaving ink droplets dispersed throughout the matrix of the sponge material in its solvent. Subsequently, the mixture is heated to a higher temperature, and the sponge solvent evaporates, which causes the polymeric sponge material to precipitate and form a solid structure around the ink droplets, resulting in a sponge containing ink droplets dispersed therein and adhering to the substrate.

Another suitable method of preparing the porous ink-filled layer is by ultraviolet polymerization of a multiphase system. An emulsion is prepared which comprises the ink composition and a monomer. This emulsion is coated onto the substrate, and the coated substrate is then exposed to ultraviolet light, which polymerizes the monomer in the emulsion, forming the polymeric sponge around the ink droplets.

A third method for preparing the porous ink-filled layer is by preparing a solution of the polymer sponge in a solvent and suspending in the solution a leachable material, such as a salt. The suspension is coated onto the substrate, and the solvent is evaporated, causing the polymeric material to precipitate and form a sponge material having the solid leachable material embedded therein. Subsequently, the sponge and substrate are soaked in water or another suitable material, causing the leachable material to leach from the sponge, leaving pores in the sponge where the solid particles once were. An inking operation can then be employed to place the ink composition into the pores. Such a process could comprise, for example, hot roll coating of the ink onto the sponge layer, followed by heating the transfer element to allow the ink to absorb into the sponge by capillary action.

Still another suitable process for preparing the porous ink-filled layer is to prepare a suspension of the polymeric sponge material in a solvent and suspending in the solution a liquid or solid blowing agent that will become gaseous upon heating to a temperature higher than that required to evaporate the solvent. The suspension is coated onto the substrate, and the solvent is evaporated, causing the polymeric material to precipitate and form a sponge material around the droplets or particles of the blowing material. Subsequent heating of the sponge and substrate causes the blowing agent to become gaseous, which "blows up" the sponge, forming pores therein. An inking operation, such as hot roll coating followed by heating, can then be employed to inject or apply the ink composition into the pores.

Thermal transfer elements of the present invention can be employed in printing processes. One embodiment of the present invention is directed to a process for forming images with a thermal transfer printing apparatus which comprises incorporating into the thermal transfer printing apparatus a transfer element which comprises a substrate upon which is situated an ink composition comprising a liquid crystalline material and a colorant and applying heat imagewise to the substrate to transfer ink imagewise from the substrate to a receiver sheet. In a specific embodiment, the element is in strip or ribbon configuration, and can be contained on a supply means, such as a supply roll or other means for holding a supply of the ribbon, and a takeup means, such as a takeup roll or other means for holding the takeup of the ribbon. As the element is used for imaging, the strip or ribbon can thus be advanced from the supply roll to the takeup roll. The supply roll and takeup roll can be contained within a cartridge if so desired. Heat is applied in imagewise fashion from the thermal printhead in the thermal transfer printing apparatus to the surface of the substrate layer of the element as it is situated between the supply and the takeup. Heat thus applied passes through the substrate to the ink layer situated on the opposite surface of the substrate and causes ink to be transferred onto a receiving sheet in imagewise fashion.

The following examples are illustrative in nature and are not intended to limit the scope of the invention. Other embodiments may occur to those skilled in the art. Parts and percentages are by weight unless otherwise indicated.

EXAMPLE I

A magenta ink composition is prepared by mixing 75 parts by weight of a polyester of the formula

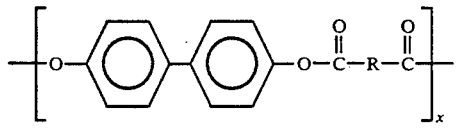

wherein R is the group $(CH_2)_7$ and x is the number of repeating units prepared according to the method set forth in Example V of U.S. Pat. No. 4,543,313, the disclosure of which is totally incorporated herein by reference, and 25 parts by weight of a magenta pigment, Lithol Rubine D4566 (Lake), available from BASF Company. The liquid crystalline polymer is heated to about 250° C., after which the pigment is added to the melt, which is continued to be mixed. To 200 parts by weight of a toluene solvent at 22° C. is then added 1 part by weight of a dispersant, Sulfonated Hydrocarbon-Petronate #9, available from Witco Chemical Company, until the dispersant dissolves in the solvent, after which the solution is cooled to room temperature. The molten liquid crystalline polymer and pigment mixture is then added to the toluene-dispersant solution, and the resulting mixture is rapidly shaken and then milled on a ball mill using stainless steel shot for about 8 hours. The resulting ink composition is solid at room temperature.

The ink thus prepared is mixed with a solution comprising 20 percent by weight of polyvinyl chloride-polyvinyl acetate random copolymer and 80 percent by weight of methyl ethyl ketone (MEK). Additional amounts of toluene and MEK are then added to the solution to produce a solution having a solids content of about 20 percent by weight, a ratio of about 50 percent MEK to 50 percent toluene, and an ink to polymer ratio of about 2 to 1. The solution is coated onto a Mylar® 23T polyester substrate in a dry thickness of about 20 microns (0.8 mil) and dried in two stages, at room temperature for 1 minute and at 95° C. for 2 minutes. The resulting transfer sheet can then be spliced into the web of a Diablo® EPM thermal transfer printer, available from Xerox Corporation, and printed 10 times with a block test pattern. It is believed that at least five prints of good quality and no background deposits can be formed on Xerox® 4024 paper by the transfer sheet thus formed.

EXAMPLE II

A black ink composition is prepared by mixing 10 parts by weight of a liquid crystalline copolycarbonate polymer of the formula

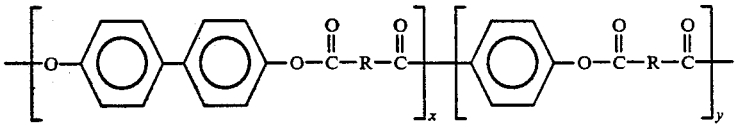

wherein R is a diethylene glycol and x and y represent the fractions of the two repeating units in the copolymer prepared according to the method set forth in Example II of U.S. Pat. No. 4,543,313, 75 parts by weight of polyethylene glycol, and 15 parts by weight of Neptun X60 black dye (BASF) at a temperature of about 170° C. to obtain a uniform mixture. To 200 parts by weight of a toluene solvent at 22° C. is then added 1 part by weight of a dispersant, Sulfonated Hydrocarbon-Petronate #9, available from Witco Chemical Company, until the dispersant dissolves in the solvent, after which the solution is cooled to room temperature. The liquid crystalline polymer, glycol, and dye mixture is then added to the toluene-dispersant solution, and the resulting mixture is rapidly shaken and then milled on a ball mill using stainless steel shot for about 8 hours. The resulting ink composition is liquid at room temperature.

The ink thus prepared is mixed with a solution comprising 20 percent by weight of polyvinyl chloride-polyvinyl acetate random copolymer and 80 percent by weight of methyl ethyl ketone (MEK). Additional amounts of toluene and MEK are then added to the solution to produce a solution having a solids content of about 20 percent by weight, a ratio of about 50 percent MEK to 50 percent toluene, and an ink to polymer ratio of about 2 to 1. The solution is coated onto a Mylar® 23T polyester substrate in a dry thickness of about 20 microns (0.8 mils) and dried in two stages, at room temperature for 1 minute and at 95° C. for 2 minutes. The resulting transfer sheet can then be spliced into the web of a Diablo® EPM thermal transfer printer, available from Xerox Corporation, and printed 10 times with a block test pattern. It is believed that at least five prints of good quality and no background deposits can be formed on Xerox® 4024 paper by the transfer sheet thus formed.

EXAMPLE III

A magenta ink composition is prepared by mixing together 40 parts by weight of the liquid crystalline polymer bisphenol-diethylene glycol polycarbonate prepared according to the method set forth in Example I of U.S. Pat. No. 4,543,313, 35 parts by weight of white refined beeswax, available from International Wax Company, 10 parts by weight of Carnauba Wax No. 1, available from Strahl & Pitsch Company, and 15 parts by weight of a magenta pigment, Lithol Rubine D4566 (Lake), available from BASF Company at a temperature of about 160° C. until a uniform mixture of the materials is obtained.

The ink thus prepared is then coated in its molten state from a gravure roller onto a Mylar® 23T polyester substrate in a dry thickness of about 5 microns and dried. The resulting transfer sheet can then be spliced into the web of a Diablo® EPM thermal transfer printer, available from Xerox Corporation, and printed with a block test pattern. It is believed that at least one print of good quality and no background deposits can be formed on Xerox® 4024 paper by the transfer sheet thus formed.

EXAMPLE IV

A black ink composition is prepared by mixing together 75 parts by weight of a polyester of the formula

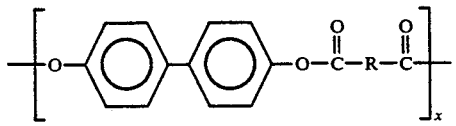

wherein R is the group $(CH_2)_7$ and x is the number of repeating units prepared according to the method set forth in Example V of U.S. Pat. No. 4,543,313, the disclosure of which is totally incorporated herein by reference, and 25 parts by weight of Neptun X60 black dye (BASF) at a temperature of about 250° C. until a uniform mixture of the materials is obtained.

The ink thus prepared is then coated in its molten state from a gravure roller onto a Mylar® 23T polyester substrate in a dry thickness of about 10 microns and dried. The resulting transfer sheet can then be spliced into the web of a Diablo® EPM thermal transfer printer, available from Xerox Corporation, and printed with a block test pattern. It is believed that at least one print of good quality and no background deposits can be formed on Xerox® 4024 paper by the transfer sheet thus formed.

EXAMPLE V

A magenta ink composition is prepared by heating and mixing together 40 parts by weight of hexyl azoxyanisole, 35 parts by weight of white refined beeswax, available from International Wax Company, 10 parts by weight of Carnauba Wax No. 1, available from Strahl & Pitsch Company, and 15 parts by weight of a magenta pigment, Lithol Rubine D4566 (Lake), available from BASF Company until a uniform molten mixture of the materials is obtained.

The ink thus prepared is then coated in its molten state from a gravure roller onto a Mylar® 23T polyester substrate in a dry thickness of about 5 microns and dried. The resulting transfer sheet can then be spliced into the web of a Diablo® EPM thermal transfer printer, available from Xerox Corporation, and printed with a block test pattern. It is believed that at least one print of good quality and no background deposits can be formed on Xerox® 4024 paper by the transfer sheet thus formed.

EXAMPLE VI

A black ink composition is prepared by heating and mixing together 75 parts by weight of diethyl azoxyanisole and 25 parts by weight of Neptun X60 black dye (BASF) until a uniform molten mixture of the materials is obtained.

The ink thus prepared is then coated in its molten state from a gravure roller onto a Mylar® 30T polyester substrate in a dry thickness of about 10 microns and dried. The resulting transfer sheet can then be spliced into the web of a Diablo® EPM thermal transfer printer, available from Xerox Corporation, and printed with a block test pattern. It is believed that at least one print of good quality and no background deposits can be formed on Xerox® 4024 paper by the transfer sheet thus formed.

The above examples are illustrative in nature, and the invention is not limited to the specific embodiments. Those skilled in the art will recognize variations and modifications that may be made which are within the scope of the following claims.

We claim:

1. A transfer element which comprises a substrate upon which is situated an ink composition comprising a liquid crystalline material and a colorant.

2. A transfer element according to claim 1 wherein the substrate is selected from the group consisting of glassine, polyester, aluminized polyester, condenser papers, and polycarbonate filled with carbon black.

3. A transfer element according to claim 1 wherein the ink is contained within a porous sponge-like layer of a polymeric material situated on the substrate.

4. A transfer element according to claim 3 wherein the polymeric material is selected from the group consisting of copolymers of polyvinyl chloride, copolymers of polyvinyl acetate, polyesters, silicone polymers, polycarbonates, polysulfones, poly phenylene oxides, block copolymers of alpha methyl styrene, and polyamides.

5. A transfer element according to claim 3 wherein the polymeric material is present in a layer of from about 12 microns to about 25 microns thick.

6. A transfer element according to claim 3 wherein the polymeric material is an elastomeric material.

7. A transfer element according to claim 1 wherein the ink composition includes a magnetically active material.

8. A transfer element according to claim 1 wherein the ink composition comprises from about 10 to about 75 percent by weight of the liquid crystalline material and from about 2 to about 25 percent by weight of the colorant.

9. A transfer element according to claim 1 wherein the liquid crystalline material undergoes a mesomorphic transition at a temperature of from about 40° to about 95° C.

10. A transfer element according to claim 1 wherein the liquid crystalline material has a viscosity of from about 3 to about 50,000 centipoise subsequent to undergoing a mesomorphic transition.

11. A transfer element according to claim 1 wherein the liquid crystalline material is selected from the group consisting of esters of azoxyanisole of a formula selected from the group consisting of:

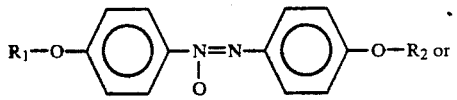

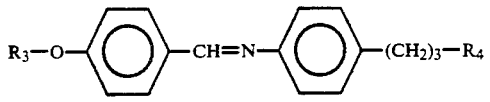

wherein $R_1$, $R_2$, $R_3$, and $R_4$ are independently selected from the group consisting of aliphatic hydrocarbon groups with from about 1 to about 30 carbon atoms.

12. A transfer element according to claim 1 wherein the liquid crystalline material is selected from the group consisting of esters of cholesterol of the formula:

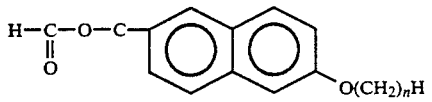

wherein n is a number of from about 1 to about 25.

13. A transfer element according to claim 1 wherein the liquid crystalline material is selected from the group consisting of methyl azolyanisole, ethyl azoxyanisole, propyl azoxyanisole, butyl azoxyanisole, pentyl azoxyanisole, hexyl azoxyanisole, heptyl azoxyanisole, octyl azoxyanisole, nonyl azoxyanisole, decyl azoxyanisole, undecyl azoxyanisole, dodecyl azoxyanisole, tridecyl azoxyanisole, tetradecyl azoxyanisole, pentadecyl azoxyanisole, hexadecyl azoxyanisole, heptadecyl azoxyanisole, octadecyl azoxyanisole, nonadecyl azoxyanisole, and mixtures thereof.

14. A transfer element according to claim 1 wherein the liquid crystalline material is selected from the group consisting of dimethyl azoxyanisole, diethyl azoxyanisole, dipropyl azoxyanisole, dibutyl azoxyanisole, dipentyl azoxyanisole, dihexyl azoxyanisole, diheptyl azoxyanisole, dioctyl azoxyanisole, dinonyl azoxyanisole, didecyl azoxyanisole, diundecyl azoxyanisole, didodecyl azoxyanisole, ditridecyl azoxyanisole, ditetradecyl azoxyanisole, dipentadecyl azoxyanisole, dihexadecyl azoxyanisole, diheptadecyl azoxyanisole, dioctadecyl azoxyanisole, dinonadecyl azoxyanisole, and mixtures thereof.

15. A transfer element according to claim 1 wherein the liquid crystalline material is selected from the group consisting of 4,4'-di-n-alkoxyazoxybenzenes, p-alkoxybenzoic acids, 4,4'-di-n-alkoxyphenylnitrones, 4-benzylidene-amino-4'-methoxybiphenyls with aromatic or heterocyclic functionalities, Schiff's bases, diphenylacetylides, cholesteryl esters, carbonates, S-alkyl carbonates, ω-phenyl alkanoates, thiocholesteryl-ω-phenylalkanoates, benzoates, naphthates, cinnamates, pyrimidines, benzilidine anilines, and mixtures thereof.

16. A transfer element according to claim 1 wherein the liquid crystalline material is a polymer.

17. A transfer element according to claim 16 wherein the liquid crystalline material is selected from the group consisting of polybenzamides, polybenzyl-y-L-glutamate, poly(biphenyl acrylates), polycarbonates, polyesters, polyurethanes, copolycarbonates, copolyesters, and mixtures thereof.

18. A transfer element according to claim 1 wherein the ink contains a magnetite.

19. A transfer element according to claim 1 wherein the colorant is selected from the group consisting of pigments, dyes, and mixtures thereof.

20. A transfer element according to claim 1 wherein the ink also includes a diluent component.

21. A transfer element according to claim 20 wherein the diluent is selected from the group consisting of saturated fatty acids, unsaturated alcohols, glycols, esters of fatty acids, unsaturated fatty acids, and mixtures thereof.

22. A transfer element according to claim 20 wherein the diluent is selected from the group consisting of carnauba wax, paraffin waxes, polyethylene waxes, polypropylene waxes, ester waxes, ethylene vinyl acetate copolymers, and mixtures thereof.

23. A transfer element according to claim 22 wherein the diluent is present in an amount of from about 1 to about 90 percent by weight of the ink.

24. A transfer element according to claim 1 wherein the ink contains an anti-smudging additive.

25. A transfer element according to claim 24 wherein the anti-smudging additive is present in the ink in an amount of from about 10 to about 90 percent by weight.

26. A transfer element according to claim 24 wherein the anti-smudging additive is selected from the group consisting of glycols and polyethylene oxide.

27. A transfer element according to claim 1 wherein the colorant is a pigment and the ink composition contains a dispersing agent.

28. A transfer element according to claim 27 wherein the dispersing agent is present in the ink in an amount of from about 0.5 to about 5 percent by weight.

29. A transfer element according to claim 1 wherein the colorant is a mixture of a pigment and a dye.

30. A process for forming images with a thermal transfer printing apparatus which comprises incorporating into a thermal transfer printing apparatus a transfer element which comprises a substrate upon which is situated an ink composition comprising a liquid crystalline material and a colorant and applying heat imagewise to the substrate to transfer ink imagewise from the substrate to a receiver sheet.

31. A process according to claim 30 wherein the transfer element is a ribbon situated between a supply means and a takeup means.

* * * * *